US007765912B1

(12) United States Patent
Serkland

(10) Patent No.: US 7,765,912 B1
(45) Date of Patent: Aug. 3, 2010

(54) CREW-SERVED MACHINE GUN AND ASSOCIATED AIRCRAFT ORDNANCE MOUNTING SYSTEM

(75) Inventor: Mark D. Serkland, Lavon, TX (US)

(73) Assignee: Contract Fabrication & Design LLC, Princeton, TX (US)

( * ) Notice: Subject to any disclaimer, the term of this patent is extended or adjusted under 35 U.S.C. 154(b) by 523 days.

(21) Appl. No.: 11/733,999

(22) Filed: Apr. 11, 2007

Related U.S. Application Data

(60) Provisional application No. 60/794,657, filed on Apr. 25, 2006.

(51) Int. Cl.
*F41A 27/00* (2006.01)

(52) U.S. Cl. ..... 89/37.21; 89/37.16; 224/401

(58) Field of Classification Search ..... 89/37.16, 89/37.21, 37.14, 37.03, 37.22; 244/118.1, 244/118.2; 224/401
See application file for complete search history.

(56) References Cited

U.S. PATENT DOCUMENTS

| | | | | |
|---|---|---|---|---|
| 3,138,994 | A * | 6/1964 | Blunk | 89/37.01 |
| 4,154,416 | A | 5/1979 | Bruce et al. | |
| 4,424,735 | A * | 1/1984 | Bacon et al. | 89/34 |
| 5,024,138 | A | 6/1991 | Sanderson et al. | |
| 5,282,410 | A * | 2/1994 | Sanderson | 89/37.16 |
| 5,417,141 | A | 5/1995 | Sanderson | |
| 5,419,234 | A | 5/1995 | Sanderson | |
| 5,421,239 | A | 6/1995 | Sanderson | |
| 5,517,895 | A | 5/1996 | Sanderson | |
| 5,767,436 | A | 6/1998 | Sanderson et al. | |
| 5,927,648 | A * | 7/1999 | Woodland | 244/118.1 |
| 6,241,185 | B1 | 6/2001 | Sanderson | |
| 6,250,196 | B1 | 6/2001 | Sanderson | |
| 6,250,197 | B1 | 6/2001 | Sanderson | |
| 6,286,411 | B1 | 9/2001 | Sanderson | |
| 6,293,179 | B1 * | 9/2001 | Sanderson | 89/37.03 |
| 6,393,960 | B1 | 5/2002 | Bilger | |
| 6,564,690 | B1 | 5/2003 | Long | |
| 6,820,532 | B2 * | 11/2004 | Sanderson | 89/41.18 |
| 7,258,055 | B1 * | 8/2007 | Javorsky | 89/37.01 |

FOREIGN PATENT DOCUMENTS

| | | | |
|---|---|---|---|
| IT | 1136908 B | * | 9/1986 |

* cited by examiner

*Primary Examiner*—Benjamin P Lee
(74) *Attorney, Agent, or Firm*—Haynes and Boone, LLP

(57) ABSTRACT

A weapon, representatively a machine gun, is mounted in a crew-served orientation on the outer end of an elongated support beam extending transversely through and secured within the cabin area of a helicopter, with the outer beam end disposed exteriorly of the helicopter. A seat structure, upon which a crew member may sit, is mounted atop a longitudinally central portion of the beam for sliding movement along the beam toward and away from the machine gun. Operatively associated with the machine gun is an ammunition box having a lid portion fixed to the bottom side of the beam end upon the top side of which the machine gun is pivotally and rotationally mounted. The body of the ammunition box is removably securable to the beam secured lid.

7 Claims, 5 Drawing Sheets

CREW-SERVED MACHINE GUN AND ASSOCIATED AIRCRAFT ORDNANCE MOUNTING SYSTEM

CROSS-REFERENCE TO RELATED APPLICATION

The present application claims the benefit of the filing date of provisional U.S. patent application No. 60/794,657 filed Apr. 25, 2006. The entire disclosure of the provisional application is incorporated herein by this reference.

BACKGROUND OF THE INVENTION

This invention relates generally to aircraft armament apparatus, and, in an illustrated exemplary embodiment, more particularly provides a crew-served weapon, representatively a machine gun, mounted on an outwardly projecting end portion of a support beam extending through the cabin area of an aircraft such as a helicopter.

SUMMARY OF THE INVENTION

In carrying out principles of the present invention, in accordance with a representatively illustrated embodiment thereof, specially designed armament apparatus is provided for an aircraft having a cabin area. In an illustrated exemplary embodiment thereof, the armament apparatus comprises an elongated support beam member transversely extendable through the cabin area and having a longitudinally intermediate section securable within the cabin area in a manner such that an outer end portion of the beam member projects outwardly beyond an exterior side portion of the aircraft. The outer end portion of the beam member has top and bottom sides, and a crew-servable weapon, representatively a machine gun, is operatively mounted on the top side of the outer end portion of the support beam member.

According to further aspects of the invention a seat is mounted on a top side portion of the support beam member, longitudinally inwardly of the weapon, for selective movement toward and away from the weapon, and an ammunition box has a lid portion anchored to the bottom side of the outer end portion of the support beam member, and a body portion removably securable to and beneath the lid portion.

DETAILED DESCRIPTION

With reference to the accompanying FIGS. 1-6, this invention provides a crew-served weapon, representatively a machine gun 10, which is pivotally and rotationally mounted, via a pintle structure 12, directly to one of the opposite ends 14*a*,14*b* of an elongated weaponry support beam 16 which may be similar in construction to the plank structure illustrated and described, for example, in U.S. Pat. No. 5,024,138 to Sanderson et al. The pintle structure 12 is preferably removable to permit other types of weaponry to be mounted to the outwardly projecting beam end.

Figure 1:
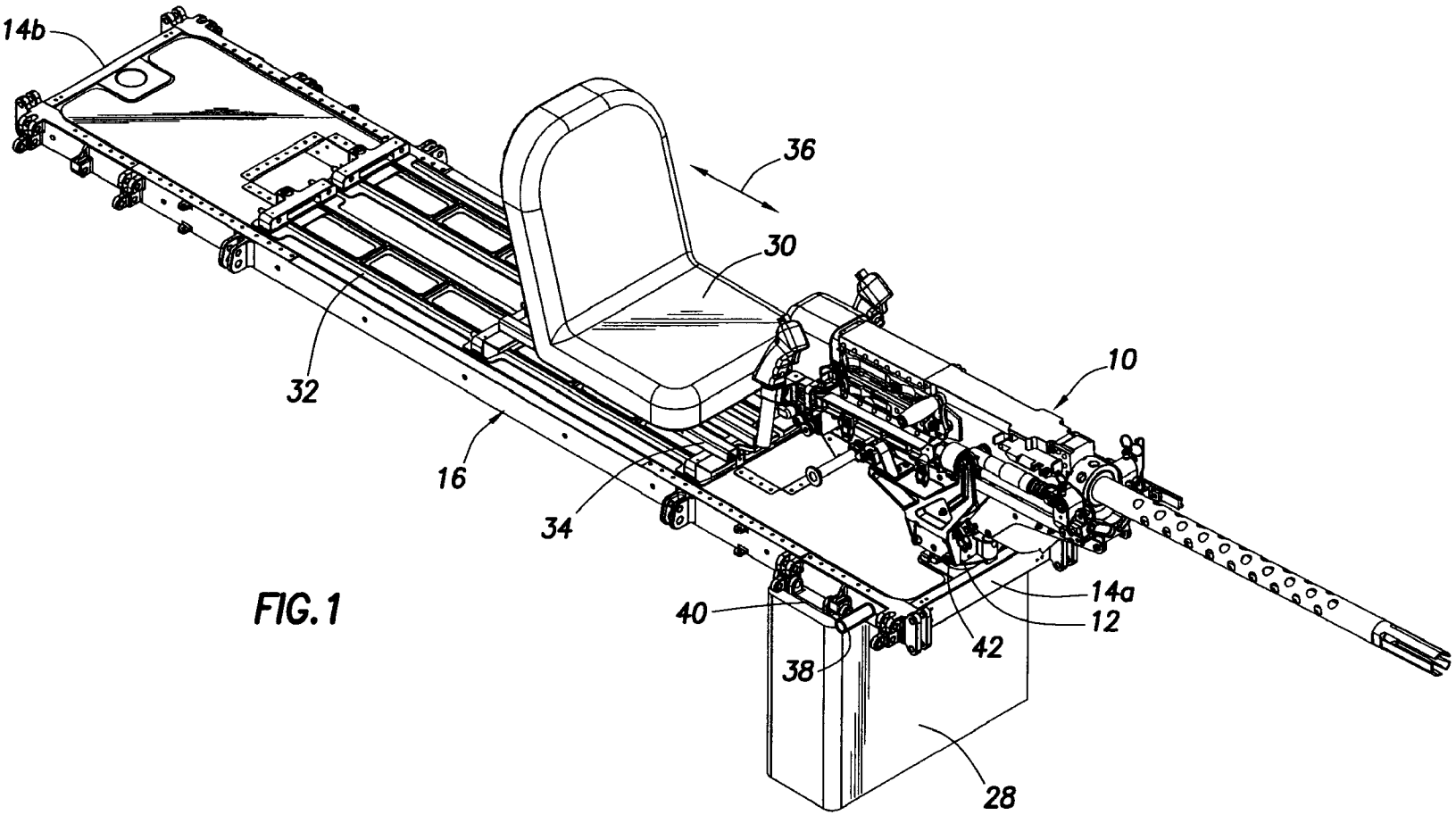
FIG. 1 is a right front perspective view of a crew-served weapon and associated aircraft ordnance mounting system embodying principles of the present invention.
Figure 2:
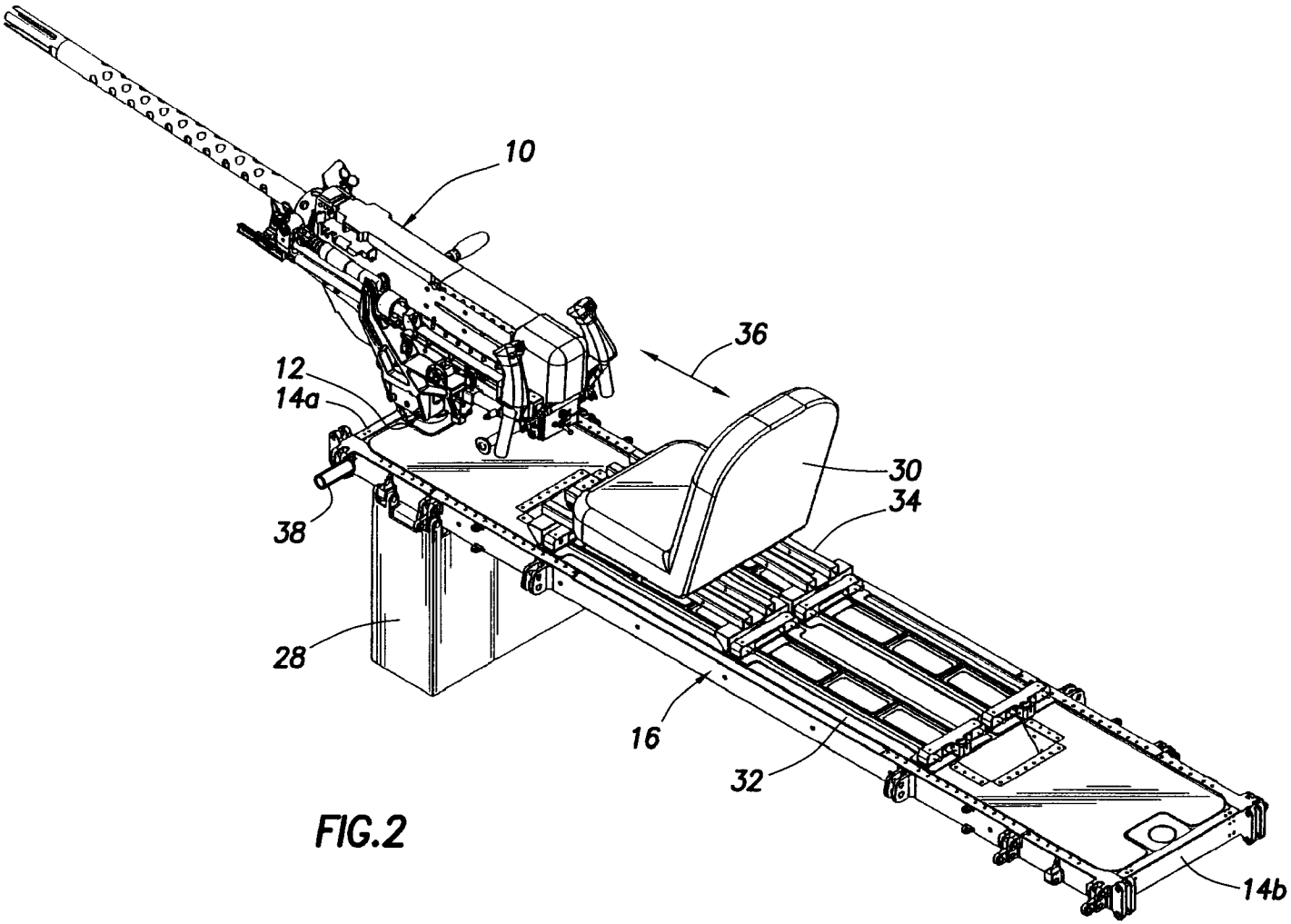
FIG. 2 is a left rear perspective view of the system.
Figure 3:
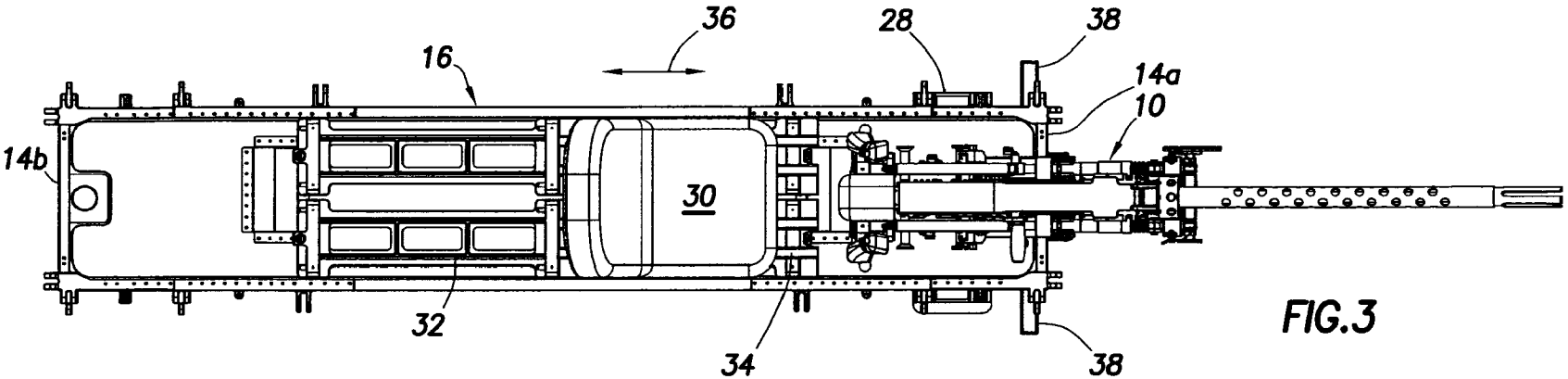
FIG. 3 is a top plan view of the system.
Figure 4:
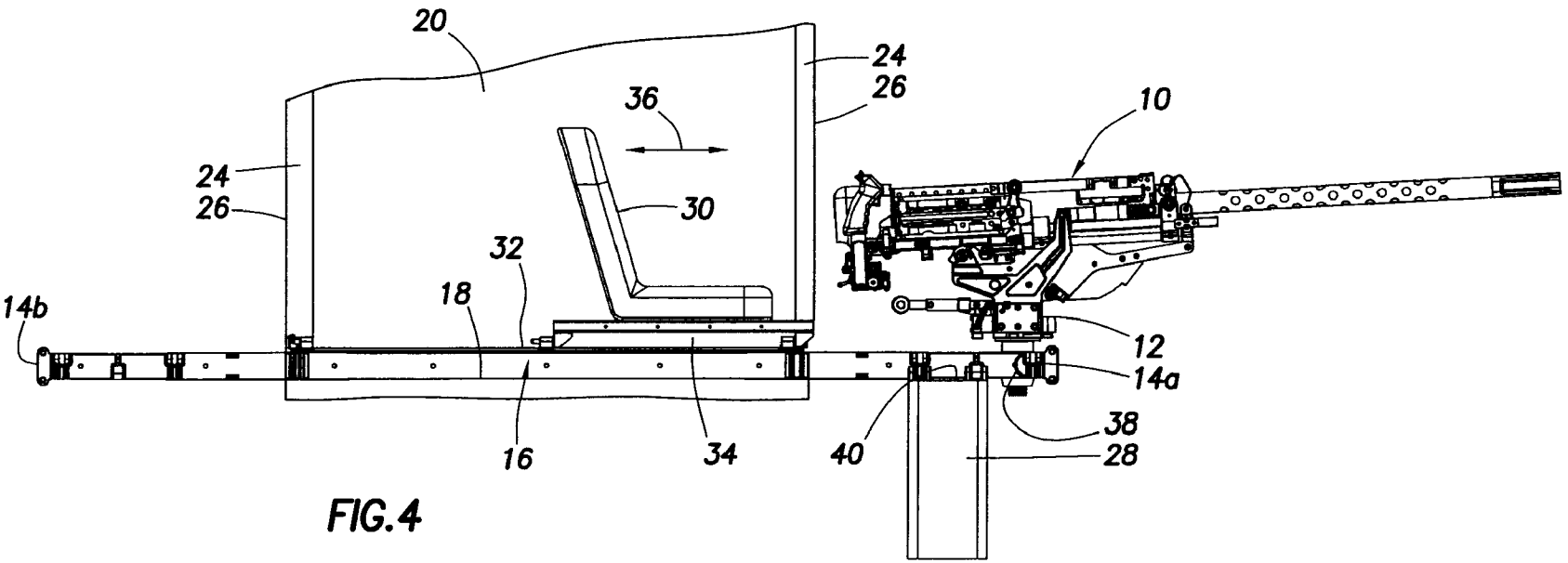
FIG. 4 is a right side elevational view of the system.
Figure 5:
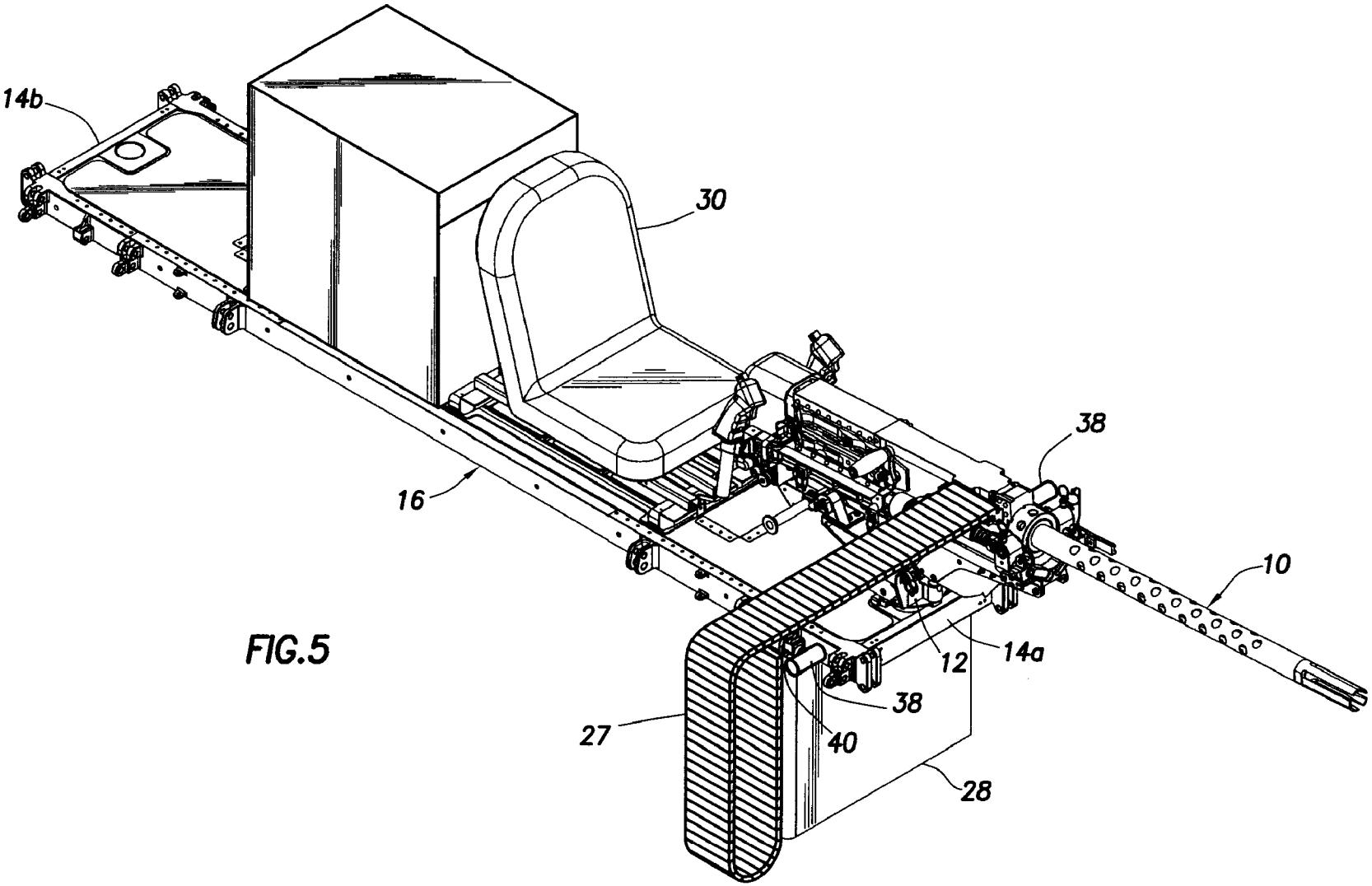
FIG. 5 is a right front perspective view of the system illustrating belted ammunition operatively connected to the crew-served weapon.
Figure 6:
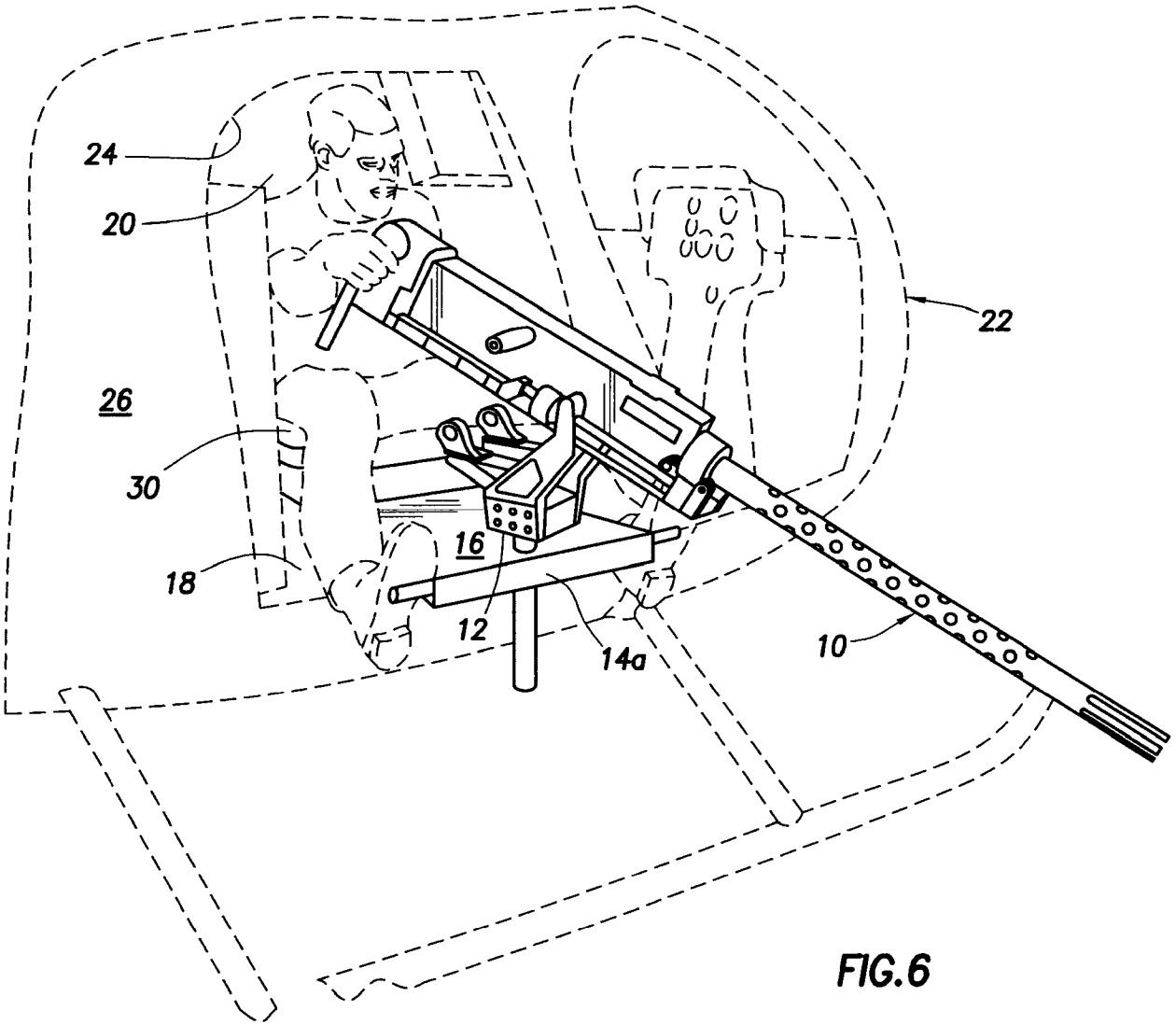
FIG. 6 is a front perspective view of the system operatively installed in a helicopter.

As illustrated in FIGS. 4 and 6, a longitudinally intermediate portion of the beam 16 is suitably anchored to the floor 18 of a cabin area 20 of an aircraft, such as the illustrated helicopter 22, with the opposite ends 14*a*,14*b* of the beam 16 projecting outwardly through openings 24 in opposite vertical cabin area walls 26. This places the machine gun 10 outboard of one of the walls 26 as illustrated in FIGS. 4 and 6. Belted ammunition 27 is operatively fed to the machine gun 10 from an ammunition magazine box 28 secured to the underside of the beam end portion 14*a*.

According to a key aspect of the invention, the machine gun 10 (which may alternately be a variety of other types of weapons) is crew-servable at the plank-mounted weapon location (as opposed to being operated from the cockpit forward of the cabin area) by means of the provision of a seat 30 which is movably supported by structure 32,34 for selected movement along the top side of a longitudinally intermediate portion of the beam 16 toward and away from the machine gun 10 as indicated by the double-ended arrow 36. Representatively, the illustrated structure 32 may be a frame secured to the top side of the plank 16, and the structure 34 may be a carrier structure anchored to the underside of the seat 30 and slidably mounted atop the frame structure 32. A suitable latch structure (not visible in the drawings) may be operatively associated with the structures 32,24 to permit the seated weapon operator to selectively lock the seat 30 in a selectively variable location along the length of the beam 16.

For comfort and bracing of the seated weapon operator, foot pegs 38 may provided and project outwardly from opposite sides of the plank end portion 14*a*. According to additional aspects of the invention, the ammunition magazine box 28 has a lid 40 which is removable from the balance of the magazine box. The lid 40 is anchored to the underside of the beam end portion 14*a* in a manner permitting the body of the magazine box 28 to be readily detached from the anchored lid 40, thereby allowing quick reloading off the helicopter. As illustrated, the pintle structure 12 extends downwardly through a suitable vertical opening 42 in the beam end 14*a* (see FIG. 1). However, the pintle structure 12 could be secured to the beam end 14*a* in a variety of other manners, including securing it to a lug portion of the beam end 14*a*, if desired.

The foregoing detailed description is to be clearly understood as being given by illustration and example only, the spirit and scope of the present invention being limited solely by the appended claims.

What is claimed is:

1. Armament apparatus for an aircraft having a cabin area, said armament apparatus comprising:

a horizontally disposed, generally plank-shaped elongated support beam member longitudinally extending transversely through the cabin area and having a longitudinally intermediate section secured directly to a floor portion of the cabin area, and an outer end portion extending outwardly beyond a side of the aircraft, said outer end portion having top and bottom sides;

a crew-servable weapon operatively mounted on said top side of said outer end portion of said support beam member; and a seat mounted on a top side portion of said support beam member, longitudinally inwardly of said weapon, for selective movement toward and away from said weapon.

2. The armament apparatus of claim 1 wherein:

said crew-servable weapon is a machine gun.

3. The armament apparatus of claim 1 further comprising:

an ammunition box having a lid portion anchored to said bottom side of said outer end portion of said support beam member, and a body portion removably securable to and beneath said lid portion.

4. For use on an aircraft having a cabin area with a floor extending between opposite outer side wall openings of the aircraft, armament apparatus comprising:

an elongated, generally plank-shaped support beam member having top and bottom sides and opposite first and second end portions, said support beam member being sized and configured to be longitudinally extendable, bottom side down, transversely through the cabin area in a manner such that said first and second end portions of said support beam member extend outwardly through and beyond the aircraft outer side wall openings, said support beam member further having a longitudinally intermediate section securable to the cabin area floor;

a weapon mounting structure, mounted on a top side portion of said first end portion of said support beam member, for operatively supporting a crew-served weapon;

a seat, mounted on said top side of said beam member, longitudinally inwardly of said weapon mounting structure, for selective movement toward and away from said weapon mounting structure; and a weapon operatively supported on said weapon mounting structure.

5. The armament apparatus of claim 4 wherein:

said weapon is a machine gun.

6. For use on an aircraft having a cabin area with a floor extending between opposite outer side wall openings of the aircraft, armament apparatus comprising:

an elongated, generally plank-shaped support beam member having top and bottom sides and opposite first and second end portions, said support beam member being sized and configured to be longitudinally extendable, bottom side down, transversely through the cabin area in a manner such that said first and second end portions of said support beam member extend outwardly through and beyond the aircraft outer side wall openings, said support beam member further having a longitudinally intermediate section securable to the cabin area floor;

a weapon mounting structure, mounted on a top side portion of said first end portion of said support beam member, for operatively supporting a crew-served weapon;

a seat, mounted on said top side of said beam member, longitudinally inwardly of said weapon mounting structure, for selective movement toward and away from said weapon mounting structure; and an ammunition box mounted on said first end portion of said support beam member.

7. The armament apparatus of claim 6 wherein:

said ammunition box has a lid portion anchored to said bottom side of said first end portion of said support beam member, and a body portion removably secured to and beneath said lid portion.

* * * * *